US008558151B2

(12) United States Patent
Seidensticker

(10) Patent No.: US 8,558,151 B2
(45) Date of Patent: Oct. 15, 2013

(54) METHOD FOR CORRECTING THE TRAJECTORY OF A PROJECTILE, IN PARTICULAR OF A TERMINAL PHASE-GUIDED PROJECTILE, AND PROJECTILE FOR CARRYING OUT THE METHOD

(75) Inventor: Jens Seidensticker, Radolfzell (DE)

(73) Assignee: Rheinmetall Air Defence AG, Zurich (CH)

( * ) Notice: Subject to any disclaimer, the term of this patent is extended or adjusted under 35 U.S.C. 154(b) by 0 days.

(21) Appl. No.: 13/549,918

(22) Filed: Jul. 16, 2012

(65) Prior Publication Data

US 2012/0292432 A1 Nov. 22, 2012

Related U.S. Application Data

(63) Continuation of application No. PCT/EP2010/007428, filed on Dec. 7, 2010.

(30) Foreign Application Priority Data

Jan. 15, 2010 (DE) ..... 10 2010 004 820

(51) Int. Cl.

| | |
|---|---|
| ***F41G 7/24*** | (2006.01) |
| ***F42B 15/01*** | (2006.01) |
| *F41G 7/00* | (2006.01) |
| *F41G 7/30* | (2006.01) |
| *F42B 15/00* | (2006.01) |

(52) U.S. Cl.

USPC ..... 244/3.13; 244/3.1; 244/3.11; 244/3.15; 244/3.16; 102/501

(58) Field of Classification Search

USPC ..... 244/3.1–3.3; 89/1.11, 1.1; 102/382, 102/383, 384, 473, 480, 501

See application file for complete search history.

(56) References Cited

U.S. PATENT DOCUMENTS

| | | | | |
|---|---|---|---|---|
| 3,501,113 | A * | 3/1970 | Maclusky | 244/3.13 |
| 3,698,811 | A * | 10/1972 | Weil | 244/3.13 |
| 3,746,280 | A * | 7/1973 | Coxe et al. | 244/3.13 |
| 3,782,667 | A * | 1/1974 | Miller et al. | 244/3.13 |
| 3,860,199 | A * | 1/1975 | Dunne | 244/3.13 |

(Continued)

FOREIGN PATENT DOCUMENTS

| | | |
|---|---|---|
| CH | 691 143 A5 | 4/2001 |
| DE | 44 16 210 A1 | 11/1995 |

(Continued)

*Primary Examiner* — Bernarr Gregory

(74) *Attorney, Agent, or Firm* — Muncy, Geissler, Olds & Lowe, PLLC

(57) ABSTRACT

A method for correcting a trajectory of a projectile is provided, in that a laser beam is guide or rotated around a center of the instantaneous target course of a projectile in such a way that the projectile itself detects a divergence thereof and subsequently carries our a selfcorrection. A first laser beam is emitted over a certain region around the target course of the projectile that can at about the same time initiate a start of a timing process. A further rotating laser beam having a fixed rotational frequency Ω can be simultaneously positioned around the region. Via the second laser beam, the projectile recognizes a divergence thereof from the target course and initiates a correction based on the determined divergence, whereby a magnitude thereof is then used to effect the timed initiation of the correction. Thus, delays in the release are implemented in the projectile.

12 Claims, 2 Drawing Sheets

(56) References Cited

U.S. PATENT DOCUMENTS

| | | | | | |
|---|---|---|---|---|---|
| 4,014,482 | A | * | 3/1977 | Esker et al. | 244/3.13 |
| 4,020,339 | A | * | 4/1977 | Gustafson | 244/3.16 |
| 4,176,814 | A | * | 12/1979 | Albrektsson et al. | 244/3.15 |
| 4,195,799 | A | * | 4/1980 | Sogo et al. | 244/3.13 |
| 4,243,187 | A | * | 1/1981 | Esker | 244/3.13 |
| 4,299,360 | A | * | 11/1981 | Layton | 244/3.13 |
| 4,300,736 | A | | 11/1981 | Miles | |
| 4,330,099 | A | * | 5/1982 | Sogo et al. | 244/3.13 |
| 4,406,430 | A | * | 9/1983 | Krammer et al. | 244/3.13 |
| 4,408,734 | A | * | 10/1983 | Koreicho | 244/3.13 |
| 4,408,735 | A | * | 10/1983 | Metz | 244/3.16 |
| 4,424,944 | A | * | 1/1984 | Wes et al. | 244/3.13 |
| 4,432,511 | A | * | 2/1984 | Tong | 244/3.13 |
| 4,441,669 | A | * | 4/1984 | Wich | 244/3.13 |
| 4,516,743 | A | * | 5/1985 | Sweeney et al. | 244/3.13 |
| 4,657,208 | A | * | 4/1987 | Miller et al. | 244/3.22 |
| 4,709,875 | A | * | 12/1987 | Cremosnik et al. | 244/3.13 |
| 4,732,349 | A | * | 3/1988 | Maurer | 244/3.13 |
| 4,768,736 | A | * | 9/1988 | Morten et al. | 244/3.11 |
| 5,102,065 | A | * | 4/1992 | Couderc et al. | 244/3.11 |
| 5,344,099 | A | * | 9/1994 | Pittman et al. | 244/3.13 |
| 5,427,328 | A | * | 6/1995 | Tong et al. | 244/3.13 |
| 5,490,643 | A | * | 2/1996 | Jano et al. | 244/3.11 |
| 5,601,255 | A | * | 2/1997 | Romer et al. | 244/3.13 |
| 5,647,559 | A | * | 7/1997 | Romer et al. | 244/3.13 |
| 5,661,555 | A | | 8/1997 | Romer et al. | |
| 5,695,152 | A | * | 12/1997 | Levy | 244/3.13 |
| 5,708,583 | A | * | 1/1998 | Solenne et al. | 244/3.16 |
| 5,932,833 | A | * | 8/1999 | Hammon et al. | 244/3.16 |
| 7,584,922 | B2 | * | 9/2009 | Bar et al. | 244/3.24 |
| 8,173,945 | B2 | * | 5/2012 | Mentink | 244/3.13 |
| 8,288,698 | B2 | * | 10/2012 | Seidensticker | 244/3.11 |
| 2007/0074625 | A1 | | 4/2007 | Seidensticker et al. | |
| 2010/0308152 | A1 | | 12/2010 | Seidensticker | |

FOREIGN PATENT DOCUMENTS

| | | | |
|---|---|---|---|
| DE | 44 16 211 | A1 | 11/1995 |
| DE | 10 2009 024 508 | A1 | 7/2011 |
| EP | 1 726 911 | A1 | 11/2006 |
| EP | 2 083 243 | A2 | 7/2009 |
| EP | 2 128 555 | A2 | 12/2009 |
| WO | WO 2009/085064 | A2 | 7/2009 |

* cited by examiner

METHOD FOR CORRECTING THE TRAJECTORY OF A PROJECTILE, IN PARTICULAR OF A TERMINAL PHASE-GUIDED PROJECTILE, AND PROJECTILE FOR CARRYING OUT THE METHOD

This nonprovisional application is a continuation of International Application No. PCT/EP2010/007428, which was filed on Dec. 7, 2010, and which claims priority to German Patent Application No. DE 10 2010 004 820.8, which was filed in Germany on Jan. 15, 2010, and which are both herein incorporated by reference.

BACKGROUND OF THE INVENTION

1. Field of the Invention

The present invention is related to the coding of a distance-dependent triggering of terminal phase-guided projectiles in the medium caliber range in particular, and preferably relates to a beam-riding method as a method for detecting the amount of deviation of the projectile.

2. Description of the Background Art

Terminal phase-guided projectiles generally must be altered in their trajectories or must themselves be capable of altering them. This is accomplished by means of actuating drives that are either aerodynamic or impulse-generating. The information for guidance is ascertained autonomously in the projectile or by means of a seeker head or alternatively is forwarded from the ground (beam-riding method).

DE 44 16 210 A1, which corresponds to U.S. Pat. No. 5,661,555, relates to a method and a device for ascertaining a roll angle position on the basis of laser light. Here, a phase-coded laser light beam is produced with the aid of a holographic optical element. This beam is decoded by means of an additional holographic element on the flying body. The signal generated in this process is then used for correction.

A method and a device for trajectory correction of projectiles are known from DE 44 16 211 A1, which corresponds to U.S. Pat. No. 5,601,255. In order to be able to correct both individual projectiles and multiple projectiles spaced closely together in time that have different deviations, it is proposed to divide a guide beam—laser—into at least five component beams or segments that are arranged around a central guide beam segment aimed at the collision point. In this design, each guide beam segment is modulated differently. With the aid of the receiving device in the projectile, said projectile then ascertains from the modulation of the guide beam segment the angular position with regard to the collision point required for the correction.

EP 2 083 243 A2 includes a method for ascertaining the roll angle position of a flying body. The method herein comprises the generation of a moving laser beam pattern over a solid angle of a laser beam within which the flying body is located. This step includes the detection of the laser light at the flying body by means of a detection point located to the side of the axis of rotation of said body as well as the pickup of the laser beam pattern at the relevant position of the detection point and ascertainment of the instantaneous roll angle position on the basis of the Doppler shift. In this method, the laser beam pattern is generated by stripes that move over the solid angle of the laser beam with a predetermined frequency.

EP 2 128 555 describes a method for ascertaining the roll angle position of a rotating projectile or flying body. In this method, a light beam transmitted from a fixed station is received by the flying body and focused at the rear of the flying body on a sensor with the aid of an optical element. In this design, the focusing is a function of the angular position of the flying body in space.

A method is known from WO 2009/085064 A2 in which the programming is carried out by the forwarding of light beams. To this end, the projectile has optical sensors on its circumference.

DE 10 2009 024 508.1, which corresponds to US 2010/0308152, relates to a method for correcting the trajectory of a round of terminal phase-guided ammunition, specifically with the projectile imprinting of such projectiles or ammunition in the medium caliber range. It is proposed therein to separately communicate with each individual projectile after a firing burst (continuous fire, rapid individual fire) and in doing so to transmit additional information regarding the direction of the earth's magnetic field for the individual projectile. The projectile imprinting takes place using the principle of beam-riding guidance of projectiles. In this process, each projectile reads only the guide beam intended for that projectile, and can determine its absolute roll attitude in space using additional information, in order to thus achieve the correct triggering of the correction pulse. This imprinting is transmitted to the projectile with an induction coil at the muzzle (CH 691 143 A5), based on the AHED method for example. Alternative transmission possibilities, for example by means of microwave transmitters, are known to those skilled in the art, for example, from EP 1 726 911 A1, which corresponds to US 2007/0074625.

SUMMARY OF THE INVENTION

It is therefore an object of the invention to provide a simple trajectory correction method that functions effectively.

Building on the basic concept of the beam-riding method for each projectile, the invention is based on the idea of guiding or rotating a collimated laser beam about the center of the instantaneous desired course of the projectile in such a manner that the projectile itself detects its deviation and then carries out a self-correction. Effectively, a method known from seeker heads is combined with the beam-riding method with no seeker head. Other forms of electromagnetic signals such as light, radar, or microwave radiation in sufficiently collimated and directed form can also be used, and also in combination with one another. Hereinafter, a laser is used by way of example for a directed transmission of information.

To this end, the projectile is tracked along its path after leaving the barrel via sensors, for example of the radar or optoelectronic type, and the actual trajectory is continuously compared to the desired trajectory. A correction may also be necessary because the target has altered its predicted trajectory; in this case the desired trajectory of the projectile is made to track the altered trajectory of the target. If the projectile is in the central circular region, it is on the desired course. In the event of a detected deviation from the desired course, if the projectile is located outside this region, the trajectory must be corrected. For the correction, an optionally modulated collimated laser beam around the center of the projectile is sent after the projectile.

For area targets, a standard correction is certainly adequate. In contrast, a more precise and measured correction is necessary for relatively small targets. To this end, either the pulse drive(s) can be designed to be variable in intensity, or else a pulse drive/the pulse drives with fixed impulse output can be ignited at different points in time relative to the expected impact point at the target. A combination of these options is also possible. If a relatively small correction of deviation is desired, the pulse drive(s) is/are only ignited shortly before the calculated impact point at the target; for a larger correction the drive is ignited correspondingly earlier for a relatively short or long remaining flight time.

So that the procedure can be initiated, a first laser flash is triggered over a specific region, preferably simultaneously triggering the start of a time counting. A second laser then rotates about a central circle, preferably with a fixed rotational frequency. The projectile detects the second laser after a certain time. This time corresponds to a position or angle around the central circle. After said projectile detects its geostationary position in space, at least one pulse drive (if more than one is incorporated, then these as well) is initiated via a sensor such that said projectile is back on the desired course at the target, and hence strikes the target.

In order to calculate the correct ignition time in relation to the time of impact, the projectile detects not only the magnitude of its deviation, but also the correspondingly earlier or later ignition of the pulse drive(s).

To this end, in a further development of the invention, the laser beam is coded in a deviation-dependent manner. In a simplest variant, this can be done by division of the laser beam into bright and dark zones in the form of a grid. If the projectile is located outside of the central core region but in the vicinity, the projectile senses fewer dark lines than in an outer region, for example, using its sensor (preferably a rear sensor). This is then interpreted as a relatively large deviation. In accordance with this coding or the set of beams, the magnitude of the deviation is then ascertained, and the correction is initiated immediately in the case of a large deviation or correspondingly later in the case of a relatively small deviation. For the tasks of ascertaining the deviation and initiating the correction, the projectile has a processor internal to the projectile in which the relevant delays are preprogrammed or stored.

Alternative codings are known to individuals skilled in the art, so that the pattern of the laser image does not have to be restricted to stripes, or else could also be evaluated as line widths. Examples of methods generally known to those skilled in the art also include time-varying codings, polarizations, or signals modulated onto carrier waves.

This method also finds application in hollow-charge projectiles or the like in addition to explosive ammunition. In this way, the high penetrating power and high temperature also make it possible to counter mortar rounds.

In summary, it is thus proposed to guide or rotate a collimated laser beam about the center of the instantaneous desired course of a projectile in such a manner that the projectile itself detects its deviation and then carries out a self-correction. To this end, a first laser beam is transmitted over a specific area around the desired course of the projectile; this laser beam can simultaneously trigger the start of a time counting. A second rotating laser beam with a fixed rotational frequency is then placed around the region, for example simultaneously. Using this second laser beam, the projectile then detects its deviation relative to the desired course and initiates the correction based on the ascertained deviation. The magnitude of the ascertained deviation is then used to carry out the timed initiation of the correction. To this end, delays of the triggering are implemented in the projectile.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
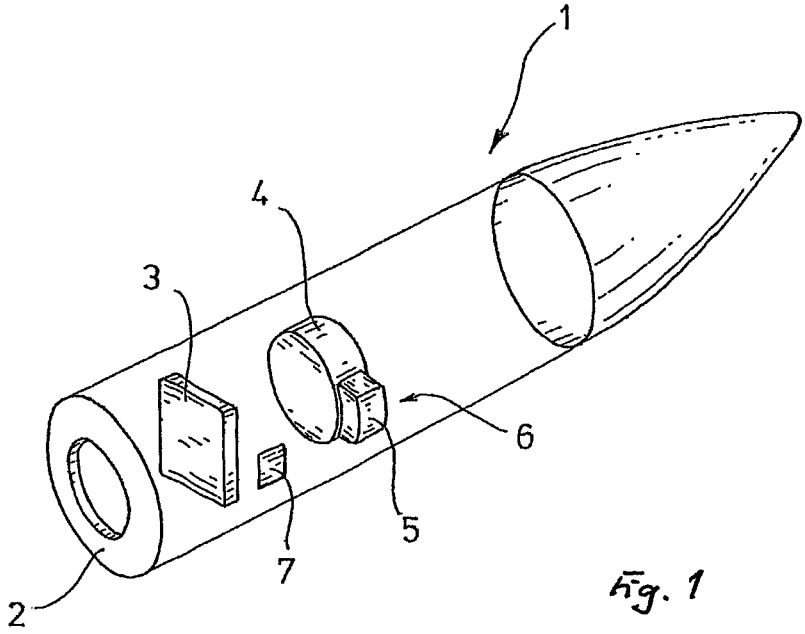
FIG. 1 illustrates a basic structure of a projectile for the method.

FIG. 1 shows a projectile or flying body 1 with a receiving window—that here is rear-mounted—and a rear sensor 2, a sensor 3, an explosive 4, and a discharge element 5 as a correction thruster 6. An on-board processor that stands in functional connection with the other components is labeled 7.

Time delays for the initiation of the pulse drive 6 in accordance with a coding are stored in the processor 7. A magnetic field sensor is preferably used as the sensor 3.

Figure 2:
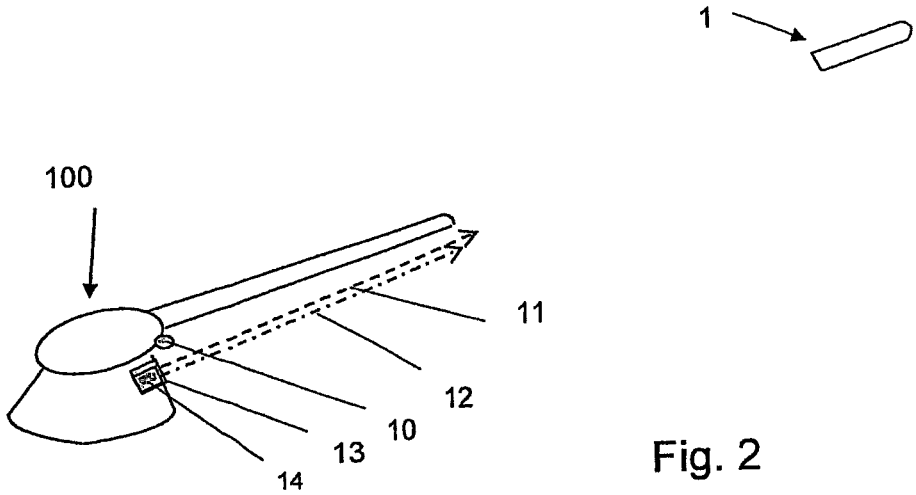
FIG. 2 illustrates an embodiment of the method on the weapon.

A sensor (radar, optical, etc) that is incorporated in the weapon 100, for example, is identified as 10, and 11 and 12 identify two laser beams that are generated by two laser devices 13, 14, for example (FIG. 2).

The mode of operation is as follows:

The magnetic field sensor 3 detects both the rotational speed (roll rate) of the projectile 1 and the direction of the Earth's magnetic field, which is known in principle, with respect to the projectile 1. The projectile 1 itself is tracked on its path by at least one sensor 10 after it leaves a barrel of a weapon not shown in detail, and the actual trajectory is continuously compared to a desired trajectory. If a deviation is ascertained, a collimated laser beam 12, which optionally is spatially modulated, is transmitted around the center of the instantaneous desired trajectory in such a manner that the projectile 1 itself detects its deviation and carries out the correction by initiating the pulse drive 6. In this process, the collimated beam 12 is sensed by the rear sensor 2.

Figure 3:
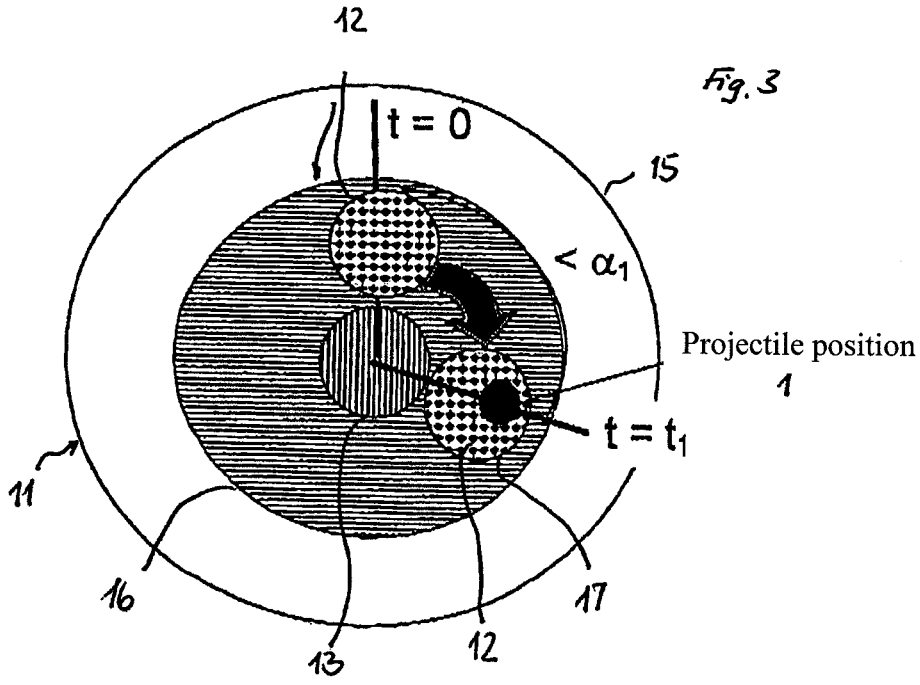
FIG. 3 illustrates a schematic diagram of the method.

FIG. 3 shows the projectile 1 in relation to various regions 15 that are formed by the collimated laser beam 11 in a plane perpendicular to the trajectory of the projectile. If the projectile is in the central circular path 13 shown in the figure with vertical hatching, it is on the desired course. In contrast, if the projectile is located outside this region 13, the trajectory must be corrected.

To this end, in a first step a first laser flash 11 is triggered over a specific region 15, and can preferably simultaneously trigger the start of a time counting. A laser, preferably a second laser, then transmits the rotating laser beam 12 starting at the time t=0 with a fixed rotational frequency Ω about the region 15 (direction of arrow) as the region 16. The projectile 1, which is located in the lower right region 17 in the exemplary embodiment, detects the second laser beam 12 after a time $t=t_1$. This time corresponds to a position in space around the central circle (13) at the angle $\alpha_1$. After detecting its geostationary position in space via the magnetic field sensor 3, the projectile 1 can initiate the pulse drive 6 so as to be located back on the desired course at the target (not shown in detail), and hence strikes the target.

In one variant, provision is made to produce a precise and measured correction for relatively small targets. In the simplest design, this can be achieved through the variable intensity of the pulse drive 6. Another possibility is that a pulse drive with fixed impulse output is ignited at different points in time relative to the expected impact point at the target.

Thus, based on this variant, the pulse drive 6 is only ignited shortly before the expected impact point at the target in the case of a relatively small deviation. In contrast, a relatively large deviation causes an earlier ignition for a relatively short or long remaining flight time.

To this end, the laser beam 12 is additionally coded. The coding can take place by means of lines (FIG. 4), points (FIG. 3), or combinations of the two, etc., in the laser beam 12.

Figure 4:
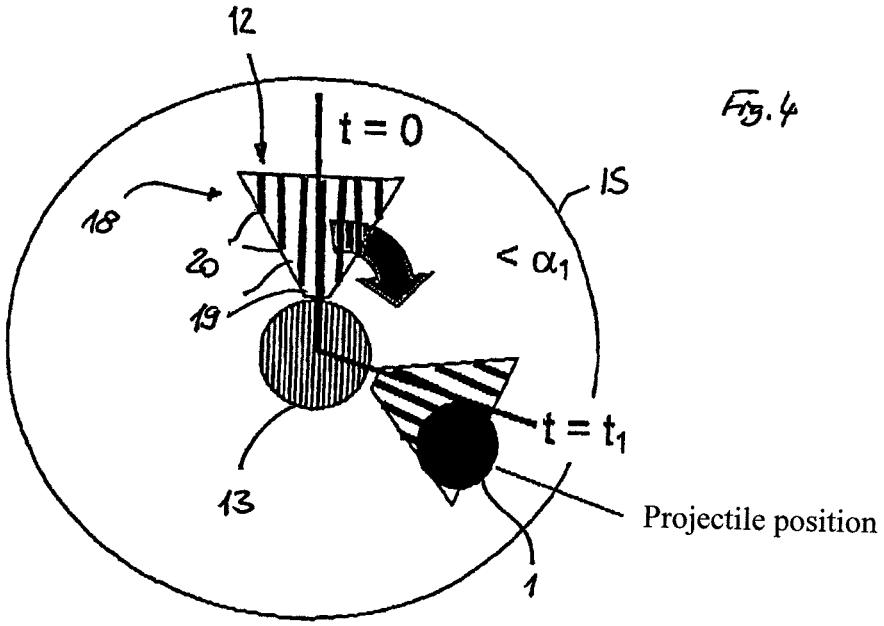
FIG. 4 illustrates a representation of a variant of the method.

FIG. 4 shows another deviation-dependent position finding. The rotating laser beam 12 is impressed (over deviation) in an asymmetric manner (which is to say that it is impressed in a varying manner in the radial direction about the desired trajectory, e.g., converging in the direction of the outer edge, or—as shown—converging in the direction of the center) and is divided into bright and dark zones 19, 20 by a grid 18. If the projectile 1 is located outside of the central core region 13 but in the vicinity, the projectile 1 senses two to three dark lines, for example, with its rear sensor 2. However, if the projectile 1 is located in the outer region, more dark lines (for example, five) are sensed, which is interpreted in the processor 7 as a larger deviation. Thus, in accordance with the coding, the projectile 1 must initiate the correction sooner or even immediately in the case of a large deviation, whereas it can take place later in time in the case of a relatively small deviation. This information is stored in the processor 7, for example from comparisons of previous identical situations, which is to say that the relevant delays are correspondingly preprogrammed in the processor 7.

The use of the method is not limited to projectiles or ammunition in the medium-caliber range; instead, its use is independent of caliber.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A method for trajectory correction of a projectile, which is terminal phase-guided, after a detection of a deviation of the projectile by a sensor on a weapon, the method comprising:

triggering a first laser beam over a specific region about a desired course of the projectile, which simultaneously triggers a start of a time counter;

transmitting an additional rotating laser beam with a fixed rotational frequency about the specific region;

detecting the second laser beam by the projectile;

ascertaining the deviation of the projectile relative to the projectile's desired course; and initiating of the trajectory correction based on the ascertained deviation.

2. The method according to claim 1, wherein the rotating laser beam starts at a time t=0, and wherein the projectile detects the second laser beam after a time $t=t_1$.

3. The method according to claim 1, wherein the correction in the case of a large deviation is initiated earlier during a remaining flight time of the projectile than the correction in the case of a small deviation, wherein the size of the deviation is based on zones of a grid.

4. The method according to claim 3, wherein delays for the initiation of the correction as a function of the ascertained deviation are stored in the projectile.

5. The method according to claim 1, wherein the rotating laser beam is coded.

6. The method according to claim 5, wherein the coding is depicted via lines, points, or combinations of the lines or points.

7. The method according to claim 1, wherein the rotating laser beam is impressed in an asymmetric manner varying in a radial direction about the desired trajectory, and wherein the rotating laser is configured to converge in one of a direction of an outer edge and a direction of a center.

8. The method according to claim 1, further comprising detecting both a rotational speed of the projectile and a direction of a magnetic field relative to the projectile.

9. The method according to claim 1, further comprising preprogramming or storing delays via which the correction is initiated as a function of a magnitude of the ascertained deviation.

10. A terminal phase-guided projectile, the projectile comprising:

a rear sensor;

an explosive;

a discharge element configured as a correction thruster; and a processor configured to ascertain a deviation of the projectile from a desired course, wherein the rear sensor is adapted to receive laser beams.

11. The projectile according to claim 10, wherein an additional magnetic field sensor detects both a rotational speed of the projectile and a direction of the magnetic field relative to the projectile.

12. The projectile according to claim 10, wherein delays are preprogrammed or stored in the processor via which the correction is initiated as a function of a magnitude of the ascertained deviation.

* * * * *